United States Patent [19]

Macaluso et al.

[11] 4,210,397

[45] Jul. 1, 1980

[54] COPYING MACHINE WITH ELECTROMAGNETIC SCAVENGER ASSEMBLY AND PROCESS

[75] Inventors: Paul J. Macaluso, Norwalk; Lawrence E. Clifford, Danbury, both of Conn.

[73] Assignee: Pitney Bowes Inc., Stamford, Conn.

[21] Appl. No.: 960,460

[22] Filed: Nov. 13, 1978

[51] Int. Cl.[2] ..... G03G 21/00

[52] U.S. Cl. ..... 355/15; 118/652; 355/3 DD

[58] Field of Search ..... 355/15, 3 DD, 16, 3 R; 118/652, 653, 657, 658; 427/18

[56] References Cited

U.S. PATENT DOCUMENTS

| | | | |
|---|---|---|---|
| 2,892,446 | 6/1959 | Olden | 118/657 X |
| 3,333,572 | 8/1967 | Olden | 118/657 X |
| 3,643,629 | 2/1972 | Kangas et al. | 118/658 |
| 3,703,395 | 11/1972 | Drexler et al. | 118/658 X |

*Primary Examiner*—R. L. Moses

*Attorney, Agent, or Firm*—Lawrence E. Sklar; William D. Soltow, Jr.; Albert W. Scribner

[57] ABSTRACT

In an electrostatic copying method and apparatus employing a two-component image-developer composition comprising magnetizable carrier particles and toner pigment particles, the removal of magnetizable carrier particles from the photoconductive surface is accomplished by means of an electromagnetic scavenger assembly comprising an electromagnet and a fixed non-magnetizable shield mounted in close association between said electromagnet and the photoconductive surface. During the copying cycle, the electromagnet is energized to create a strong magnetic field around the shield and to cause magnetizable articles to be drawn against the shield from the photoconductive surface. After the copying cycle, the electromagnet is automatically de-energized to discontinue the strong magnetic field in the area of the shield, causing the magnetizable particles to fall from the shield into a collection tray by means of gravity.

11 Claims, 2 Drawing Figures

COPYING MACHINE WITH ELECTROMAGNETIC SCAVENGER ASSEMBLY AND PROCESS

BACKGROUND OF THE INVENTION

The problem of iron carry-out is common in the case of electrostatic copying machines which employ a two-component developer composition comprising toner powder and a magnetizable carrier powder for said toner powder, such as an iron powder. The developer powder mixture is present in a developer station through which the latent-imaged photoconductive surface is moved. The developer station comprises a powder applicator roller which is charged with a negative voltage of 150 volts d.c., while the latent electrostatic images present on the photoconductive surface have a potential of negative 500 volts.

Due to the triboelectric effect of the powder particles rubbing together in the developer station, the iron powder particles become negatively charged and the toner powder particles become positively charged. The positive toner particles are attracted to the latent images while the negative iron particles are not attracted, whereby only the toner particles transfer to the photoconductive surface for subsequent transfer to a copy sheet and fusion thereon as duplicate images.

In practice, various small amounts of the iron powder particles do, in fact, transfer to the photoconductive surface, causing abrasion damage to the photoconductive surface and/or degradation of the quality of the copies produced due to background staining and/or damage to the machine parts and/or waste of iron powder.

It is not clear why the iron powder transfers to the photoconductive surface. It appears that the separation of the toner particles from the iron particles leaves the iron particles with a excess of negative charges which causes the iron particles to be attracted to the electropositive toner layer on the photoconductive surface. Regardless of theory, the problem exists and there have been proposals for various scavenger means for overcoming the problem.

U.S. Pats. Nos. 3,457,900 and 3,894,513 disclose devices for removing iron particles from a photoconductive surface comprising a magnet fixed within a rotating sleeve of non-magnetizable material which must be positioned beneath the photoconductive surface in order to continuously release the attracted iron particles during the copying cycle.

U.S. Pat. No. 3,993,022 discloses a similar apparatus, including a complex conveyor system for removing iron particles from a master surface and conveying them to a collecting tray during the copying cycle.

U.S. Pat. No. 3,739,749 relates to another proposed apparatus for removing iron particles and causing them to move back to the developer station in response to the rotation of adjacent permanent magnets within a sleeve.

Such prior known devices add substantially to the cost and complexity of an electrostatic copying machine, are subject to breakdown and failure due to their many moving parts and to the fact that such parts are in constant movement during the copying cycle.

SUMMARY OF THE INVENTION

The present invention relates to an electrostatic copying machine which employs a two-component magnetic developer mixture and which includes a simplified electromechanical magnetic scavenger assembly comprising a fixed electromagnet and a fixed non-magnetizable shield, neither of which requires any movable parts either while the assembly functions to remove iron carry-out from the electroconductive master surface during the copying cycle or to remove any magnetic particles which were picked out during each copying cycle shield and permit magnetic particles attracted to the shield to fall into a collection tray.

The present electromagnetic scavenger assembly comprises a shield of non-magnetic material which is mounted in fixed position, closely spaced from the photoconductive surface of the master which moves thereunder and of sufficient width to extend across the entire width of the master, and an electromagnet which is mounted in fixed position adjacent the rear surface of the shield and is adapted to be energized to create a magnetic field in the area of the shield during the copying cycle and which is adapted to be de-energized when the copying cycle is completed to remove the magnetic field from the area of the fixed shield, thereby permitting the magnetic particles to lose attraction for the shield and to fall into a collection tray.

The present electromagnetic scavenger assembly is mounted along the path of the photoconductive surface, such as along the path of a moving master web in a xerographic copying machine of the type disclosed in U.S. Pat. Nos. 4,053,223 and 4,051,986, the disclosures of which are incorporated herein by reference. The scavenger assembly is located beyond or downstream from the developer unit, where the toner powder is transferred to the charged photoconductive surface of the master web, and before the transfer station, where the toner-imaged surface of the master web is brought into contact with a copy sheet to cause transfer of the toner images to the copy sheet.

The operation of the scavenger assembly coincides with the operation of the copying machine. When the machine is idle, the electromagnet is de-energized, whereby there is no magnetic field in the area of the fixed shield. When the machine is started, the magnet is automatically energized behind and adjacent the fixed shield to create a strong magnetic field around and through the shield to cause magnetic carrier particles to be drawn from the closely-spaced toner-developed surface of the master web against the surface of the shield where they are retained for so long as the copying machine is running and until the machine becomes idle and the magnet is automatically de-energized. Such de-energization discontinues the magnetic field in the area of the fixed shield, whereby the magnetic particles fall from the shield into a collection tray.

Other features and advantages of the present invention will be apparent to those skilled in the art in the light of the present disclosure, including the drawing.

DETAILED DESCRIPTION OF THE DRAWING

Figure 1:
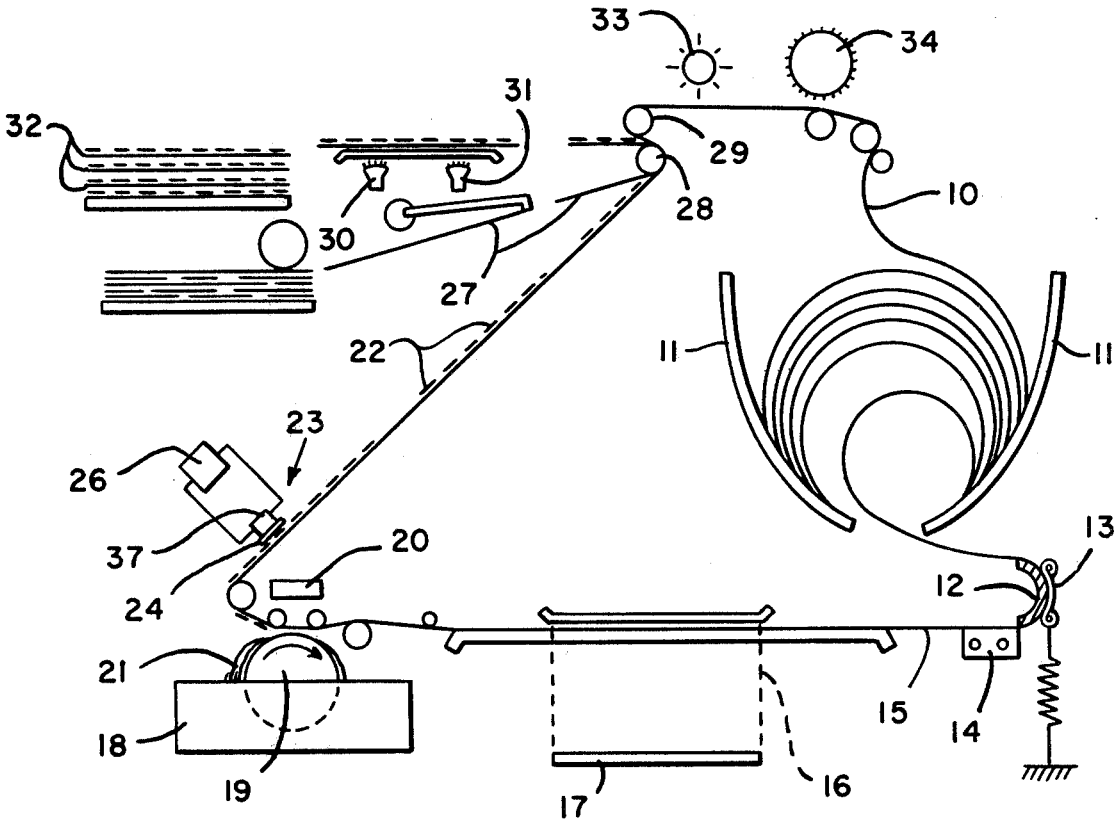
FIG. 1 is a diagrammatic cross-sectional view of a portion of an electrostatic copying machine illustrating the continuous path of a photoresponsive master web, the different operations carried out in connection therewith and a preferred location for the present electromagnetic scavenger assembly in relation to said operations.

FIG. 1 illustrates an electrostatic copying apparatus comprising a continuous, folded photoresponsive master web 10 which is dispensed from container hopper 11, passes between guide element 12 and brake element 13 and is drawn into the charging station and across the electrostatic charging device 14 with the photoresponsive surface 15 of the web 10 in close proximity to the charging device 14. The energized charging device 14 produces a potential of negative 500 volts over the entire photoreceptive surface 15. The continuously-moving charged web then passes into the exposure station 16 where it is exposed to the flash reflection 17 of a strobe-illuminated original sheet. The electrostatic charges are dissipated and reduced or removed from the exposed areas of the photoreceptive surface 15, in proportion to the degrees of reflected illumination received from the different areas of the original sheet.

Thereafter, the moving exposed web enters the development station 18 into close proximity with the application roller 19 and under magnet 20. The developer composition 21 comprises a mixture of fine magnetic particles and a minor amount of heat-fusible toner powder which is carried by the magnetic particles but which has a greater affinity for the electrostatic charges remaining on the photoreceptive surface 15. Application roller 19 is charged with a negative voltage of 150 volts d.c. to attract the developer mixture 21 to its surface so that the mixture can be carried by the roller 19 and drawn into proximity with the more strongly charged surface 15 of the web 10 by means of magnet 20. The toner particles separate from the magnetic carrier particles and transfer to the charged areas of the surface 15 in amounts proportional to the strength of the electrostatic charges remaining on surface 15 to form toner images 22 corresponding to the images on the original sheet.

The developed or toner-imaged web then passes beneath the activated scavenger assembly 23 comprising the fixed shield 24 and the electromagnet 25 which is energized by means of power supply 26 to create a magnetic field around and through the shield and extending to the surface of the imaged web.

The shield and magnet extend across the width of the web and cause any magnetic carrier powder particles which may have transferred to the surface 15 of the web in the development station 16 to be drawn from surface 15 against the non-magnetic shield 24 and to be retained there by the force of the magnet so long as the magnet is energized.

The toner-imaged web, cleaned of any magnetic carrier particles, then continues its movement to the transfer station where the toner-imaged surface of the web is brought into contact with a succession of copy sheets 27, compressed between idler roller 28 and web transport roller 29 which have different polarities which induce transfer of the toner images 22 to the surface of the copy sheet 27.

The toner-imaged copy sheets pass through a heat-fusion zone comprising radiant heat lamps 30 and 31 which cause the toner composition to fuse to the copy paper to form the final copies 32. The continuous master web passes from the transfer station, through a cleaning station including an exposure lamp 33 and a cleaning brush 34 and back into folded condition within the master container hopper 11 for reuse.

After the copy cycle is completed, i.e., all portions of the web which have been developed with toner pass the transfer station, the copying machine shuts off automatically which deactivates the power supply 26 for the electromagnet, thereby removing the magnetic field from shield 24 and causing any magnetic particles which are attracted against the surface of shield 24 to fall onto the adjacent inclined surface 15 of web 10 and to slide back into the development station 18 or into a collection tray which may be present in or adjacent to the development station.

Figure 2:
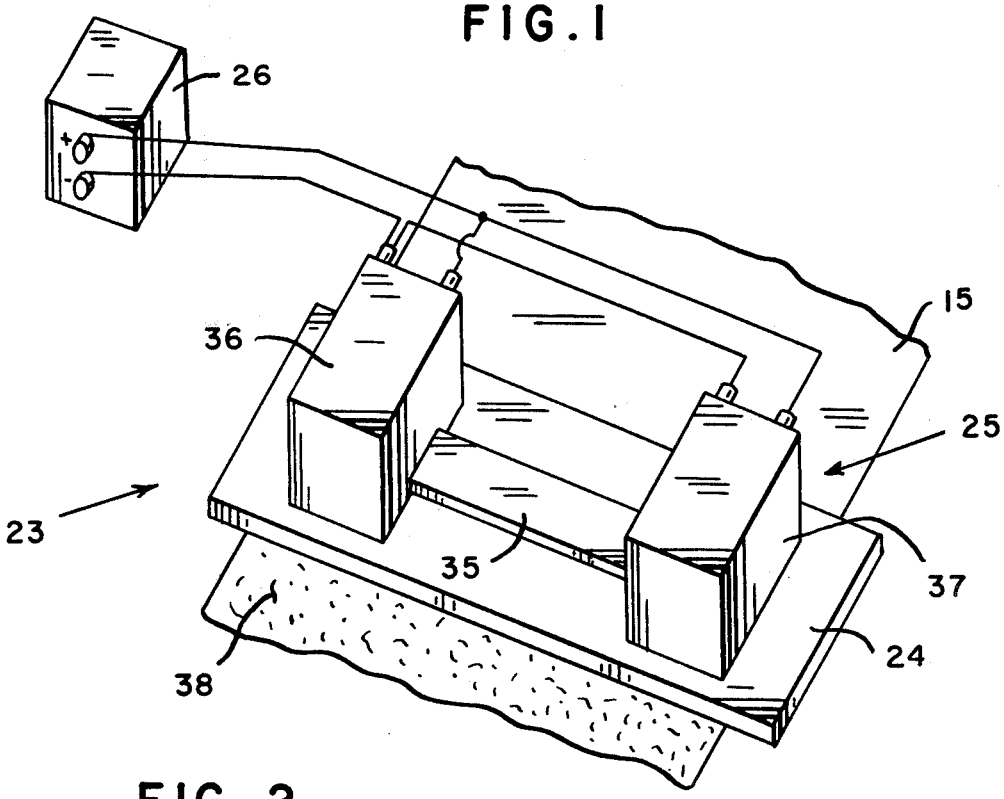
FIG. 2 is a perspective view of the electromagnetic scavenger assembly of FIG. 1 positioned over the photoconductive web during the copying cycle.

The scavenger assembly 23, as illustrated, comprises the non-magnetic shield 24 which is bolted to the frame of the copying machine and is sufficiently wide to underlie a magnetizable cross-member 35 which is connected to two electromagnetic coils 36 and 37 of the electromagnet 25, said coils being electrically connected to the power supply 26, as illustrated by FIG. 2 of the drawing.

In operation, the power supply 26 energizes the coils 36 and 37 automatically when the copying cycle of the machine is activated and the coils remain energized at all times during the copying cycle so that the electromagnet 25 is energized at such times. In such condition, the field of the electromagnet 25 extends through the shield 24, which consists of non-magnetic material such as plastic or aluminum, and onto the photoreceptive surface 15 of the master web 10 which has been developed with toner images 22, as shown in FIG. 1. The magnetic field causes any magnetic particles and "carried-out"toner present on the surface 15 to be drawn away from surface 15 and held against the undersurface of the shield 24. Thus, the surface 15 which passes the scavenger assembly 23 is completely free of any magnetic particles, such as iron carrier powder, which could damage the surface 15 or the machine mechanism and "carried-out" toner which could degrade the quality of the duplicate copies 32 by forming background.

When the copying cycle is completed, i.e., movement of the last charged portion of the web 10 past the transfer station and back to the hopper 11 has been completed, the copying cycle is de-energized to cease movement of the web and de-energize the power supply 26 to coils 36 and 37, causing a cessation of the magnetic field in the area of the shield 24, whereby the magnet particles which were attached to and held against the undersurface of shield 24 lose their attraction for the shield. Thus the particles fall from the shield 24, under the effects of grayity, onto the inclined surface 15 of the web 10 and slide back into the developer station or, more preferably, into a collection tray adjacent the developer station.

As will be clear to those skilled in the art, the present scavenger assembly is relatively simple and has no moving parts which are susceptible to wear or breakdown. Magnet 25 is a conventional magnet which provides instantaneous energization/de-energization in response to the presence or absence of current from power supply 26. Power supply 26 may be a conventional component, such as a generator, capable of reliable use over an extended period of time. Shield 24 is a simple fixed plate of aluminum, plastic or other non-magnetic material which is mounted so that its undersurface is parallel to the web 10 and sufficiently spaced therefrom that there will be no contact between any magnetic particles attracted to such undersurface and the raised toner images 22 present of surface 15 . Generally, the distance between the surface 15 and the undersurface of the shield 24 will be at least about 0.04 inch. The maximum spacing will depend upon the field strength of the particular magnet used, but the spacing generally will not exceed about 0.25 inch. A preferred distance range is from about 0.06 inch to about 0.12 inch. The rear surface of the shield may be in contact with the electromagnet or may be spaced therefrom. The essential requirements are (a) the energized electromagnet must be sufficiently close to the master web to be effective in removing magnetic particles therefrom to the shield, and (b) de-energized electromagnet must be sufficiently spaced from the front or collection surface of the shield so that any residual magnetism remaining in the electromagnet, when it is de-energized, will have no effect upon iron particles accumulated on the front or collection surface of the shield, whereby said particles will be released from said surface. However, it should be understood that the non-magnetic shield need not be a separate element from the electromagnet, and may be a non-magnetic plastic or aluminum strip, plate or heavy coating present over the underside of the electromagnet, adjacent the path of the master web, provided that said strip, plate, coating, etc. is sufficient to be effective as a barrier against any residual magnetism present in the de-energized electromagnet from extending to the front or collection surface of said strip, plate, coating, etc., whereby any iron particles accumulated on said front surface will be released when the electromagnet is de-energized.

Variations and modifications of the present apparatus will be apparent to those skilled in the art, within the scope of the present claims.

We claim:

1. In an electrostatic copying apparatus comprising a continuous photoresponsive master, means for moving said master through a copying cycle comprising a charging station in which the photoresponsive surface of the master is provided with an electrostatic charge, an exposure station in which the charged surface is exposed to the light image of an imaged original sheet being copied, whereby the electrostatic charge is removed from said surface except in latent image areas exposed to the imaged areas of said original, a development station in which said latent image areas are developed by means of toner powder present in a two-component composition comprising said toner powder and magnetic carrier particles, and an image-transfer station in which said developed images are transferred to a copy sheet and fused thereon, the improvement which comprises an electromagnet which is fixedly attached to said apparatus at a location beyond said development station and in advance of said transfer station and which is positioned across and closely-spaced from the path of the master, a non-magnetic shield fixedly secured to said apparatus and associated with said electromagnet and positioned between said electromagnet and the photoresponsive surface of said master, parallel to and uniformly closely-spaced from said photoresponsive surface; means for energizing said electromagnet during movement of the master through the copying cycle to create a sufficient magnetic field through said shield to attract any magnetic carrier particles which may be present on the surface of said photoresponsive master from said master to the adjacent collection surface of said shield, and means for de-energizing said electromagnet after said copying cycle is completed to discontinue said magnetic field in the area of said shield to cause said magnetic particles to be released from the collection surface of the shield.

2. An apparatus according to claim 1 in which said non-magnetic shield is metallic.

3. An apparatus according to claim 1 in which said non-magnetic shield is plastic.

4. An apparatus according to clam 1 in which said electromagnet comprises a pair of spaced coils joined by means of a magnetizable cross-member.

5. An apparatus according to claim 1 in which said means for moving said master is electrically associated with said means for energizing and de-energizing said electromagnet, whereby said magnet is energized at all times during movement of said master and is automatically de-energized when said copy cycle is completed and movement of said master is ceased.

6. An apparatus according to claim 1 in which the collection surface of said non-magnetic shield is positioned at an inclined angle parallel to an inclined section of the continuous master.

7. An apparatus according to claim 1 in which the collection surface of said shield is spaced from the surface of the master by a distance of from about 0.04 inch to about 0.10 inch.

8. In an electrostatic copying method comprising the steps of moving a continuous photoresponsive master through a copying cycle comprising a charging station in which the photoresponsive surface of the master is provided with an electrostatic charge, an exposure station in which said charged surface is exposed to the light image of an imaged original sheet being copied, whereby the electrostatic charge is removed from said surface except in latent image areas exposed to the image areas of said original, a development station in which said latent image areas are developed by means of toner powder transferred thereto from a two-component developer composition comprising said toner powder and magnetic carrier particles, and an image-transfer station in which said developed images are transferred to a copy sheet and fused thereon, the improvement which comprises attaching and electromagnet to said apparatus at a location beyond said development station and in advance of said transfer station, across and closely-spaced from the path of the master; positioning a non-magnetic shield between said electromagnet and the photoresponsive surface of said master, parallel to and uniformly closely-spaced from said photoresponsive surface; energizing said electromagnet during movement of the master through said shield to attract any magnetic carrier particles which may be present on the surface of said photoresponsive master from said master to the adjacent collection surface of said shield, and de-energizing said electromagnetic after said copying cycle is completed to discontinue said magnetic field in the area of said shield to cause said magnetic particles to be released from the collection surface of the shield.

9. The method according to claim 8 in which said continuous photoresponsive master is a paper web carrying a coating comprising the photoresponsive surface thereof.

10. The method according to claim 8 in which said magnet is energized at all times during movement of said continuous master and is de-energized after movement of said continuous master is stopped.

11. The method according to claim 8 in which said shield is positioned at an inclined angle parallel to an inclined section of the continuous master whereby any magnetic particles released from the surface of said shield, when the magnet is de-energized, fall onto the inclined surface of the master and slide from said surface into a collection tray.

* * * * *